US008581817B2

(12) United States Patent
Wang

(10) Patent No.: US 8,581,817 B2
(45) Date of Patent: Nov. 12, 2013

(54) LIQUID CRYSTAL DISPLAY AND METHOD FOR CONTROLLING SAME

(75) Inventor: Jian-Feng Wang, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 877 days.

(21) Appl. No.: 12/387,974

(22) Filed: May 11, 2009

(65) Prior Publication Data

US 2009/0278854 A1 Nov. 12, 2009

(30) Foreign Application Priority Data

May 9, 2008 (TW) ..... 97117134 A

(51) Int. Cl.
*G09G 3/36* (2006.01)

(52) U.S. Cl.
USPC ..... 345/89; 345/690

(58) Field of Classification Search
USPC ..... 345/87, 89, 204, 581, 690
See application file for complete search history.

(56) References Cited

U.S. PATENT DOCUMENTS

| | | | | |
|---|---|---|---|---|
| 6,795,091 | B2 | 9/2004 | Kim | |
| 7,277,078 | B2 | 10/2007 | Sato et al. | |
| 7,336,823 | B2 * | 2/2008 | Guldevall | 382/169 |
| 2004/0246276 | A1 * | 12/2004 | Koyama | 345/690 |
| 2005/0094170 | A1 * | 5/2005 | Ichitani | 358/1.9 |
| 2007/0046596 | A1 * | 3/2007 | Sakakibara et al. | 345/87 |

FOREIGN PATENT DOCUMENTS

CN 1209906 C 7/2005

* cited by examiner

*Primary Examiner* — James Wozniak
*Assistant Examiner* — Calvin C Ma
(74) *Attorney, Agent, or Firm* — WPAT, PC; Justin King

(57) ABSTRACT

An LCD includes an OSD system and a gamma correction circuit. The OSD system includes an input system for setting gamma values. The gamma correction circuit includes a look-up table. The look-up table includes a plurality of sub-look-up tables, each corresponding to a gamma value. Each sub-look-up table stores a plurality of original gray level values and a plurality of corrected gray level values corresponding to the original gray level values. The gamma correction-circuit receives an original gray level value corresponding to a video signal, and searches a sub-look-up table corresponding to a set gamma value for a corresponding corrected gray level value. A method for controlling the LCD is also provided.

12 Claims, 2 Drawing Sheets

LIQUID CRYSTAL DISPLAY AND METHOD FOR CONTROLLING SAME

BACKGROUND

1. Technical Field

The present disclosure relates to a liquid crystal display (LCD) and a method for controlling the LCD.

2. Description of Related Art

Onscreen display (OSD) systems allow adjustment of display parameters of an LCD, such as brightness, contrast, color temperature, and phase corresponding with user needs.

Often when an LCD converts a video signal to an image, brightness of the image is determined by intensity of the video signals. Between a brightest level and a darkest level are 256 levels. Each level is referred to as a gray level. Different users may perceive gray levels differently, and perception may further change with environment. Thus, gamma correction optimizes the display of the LCD. In most cases, a gamma value of an LCD is preset to 2.2. By checking a gamma correction table, a corrected gray level is determined according to a corresponding video signal. Thus gamma correction is performed on the video signal.

However, because the gamma value of the LCD is preset, if a corrected brightness is unacceptable, the gamma value cannot be manually adjusted, making the LCD less user-friendly.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Figure 1:
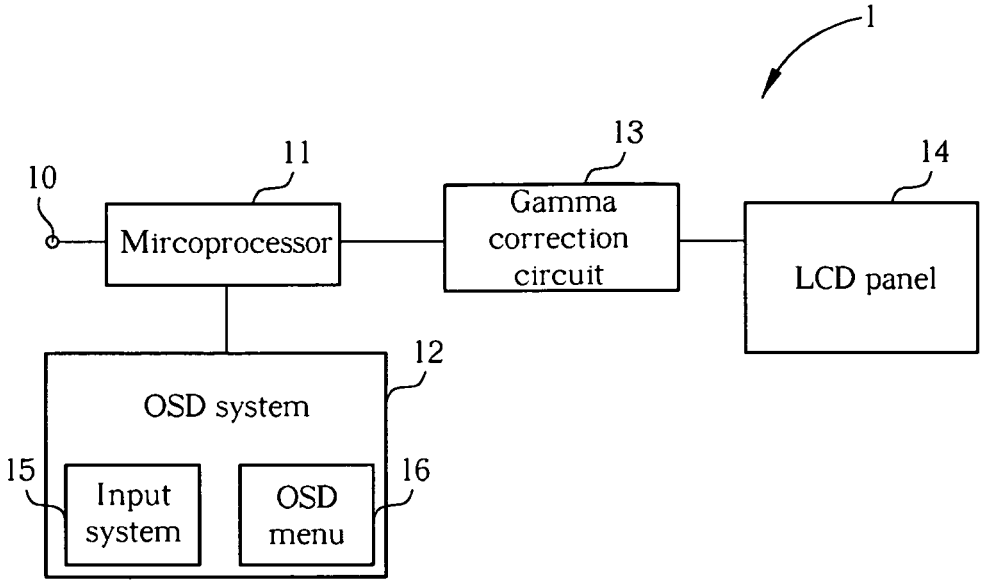
FIG. 1 is a block diagram of an LCD according to the present disclosure.
Figure 2:
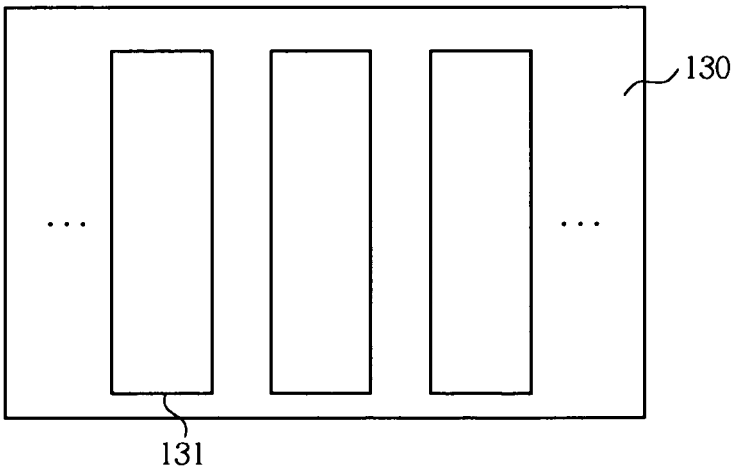
FIG. 2 shows a look-up table of the LCD in FIG. 1 according to a first embodiment of the present disclosure.

FIG. 1 is a block diagram of an LCD 1 according to the present disclosure, and FIG. 2 shows a look-up table 130 of the LCD 1 according to a first embodiment of the present disclosure. The LCD 1 includes a video signal input node 10, a microprocessor 11, an OSD system 12, a gamma correction circuit 13, and an LCD panel 14. The video signal input node 10 is coupled to the microprocessor 11. The OSD system 12 is coupled to the microprocessor 11. The microprocessor 11 is coupled to the gamma correction circuit 13. The gamma correction circuit 13 is coupled to the LCD panel 14.

The video signal input node 10 transmits an external video signal to the microprocessor 11. After the microprocessor 11 receives the video signal and generates an original gray level value accordingly, the microprocessor 11 transmits the original gray level value to the gamma correction circuit 13. The original gray level value represents an image brightness of the video signal.

The gamma correction circuit 13 includes a look-up table 130. The look-up table 130 includes a plurality of sub-look-up tables 131, each of which corresponds to a gamma value, and has a plurality of original gray level values and a plurality of corrected gray level values corresponding to the plurality of original gray level values. The corrected gray level values represent the image brightness of video signals after gamma correction. The values stored in the sub-look-up tables 131 are compressed by a 10-bit compression method, in one embodiment.

After receiving the original gray level value from the microprocessor 11, the gamma correction circuit 13 searches the sub-look-up table 131 corresponding to a preset gamma value for the corrected gray level value according to the original gray level value, and then outputs the corrected gray level value to the LCD panel 14. The LCD panel 14 then displays a corresponding image according to the corrected gray level value.

The OSD system 12 includes an input system 15 and an OSD menu 16. The input system 15 enables input of OSD instructions and opening of the OSD menu 16. The OSD menu 16 can be displayed on the LCD panel 14, and has a gamma value adjustment option. The gamma value adjustment option has a gamma value range. Once the OSD menu 16 is displayed and the gamma value adjustment option has been enabled, the gamma value can be set or adjusted within the gamma value range.

After adjustment of the gamma value through the gamma value adjustment option, the OSD system 12 generates a corresponding control signal to the microprocessor 11 according to the adjusted gamma value. The microprocessor 11 directs the gamma correction circuit 13 according to the control signal to set the sub-look-up table 131 corresponding to the adjusted gamma value through the input system 15 as an active look-up table. When the microprocessor 11 receives a current video signal, an original gray level value is generated and transmitted to the gamma correction circuit 13, which searches the active look-up table for a corrected gray level value corresponding to the original gray level value, and outputs the corrected gray level value to the LCD panel 14. The LCD panel 14 then displays an image according to the corrected gray level value.

The gamma correction circuit 13 of the LCD 1 includes the sub-look-up tables 131 corresponding to all available gamma values. The OSD menu 16 provides the gamma value adjustment option, allowing adjustment of gamma value according to preference through the input system 15. After adjustment, the gamma correction circuit 13 sets the sub-look-up table 131 corresponding to the adjusted gamma value as an active look-up table. Adjustment is, correspondingly, fast and simple. Moreover, the gamma correction circuit 13 performs correction with the active look-up table, allowing gamma correction to achieve improved accuracy.

Figure 3:
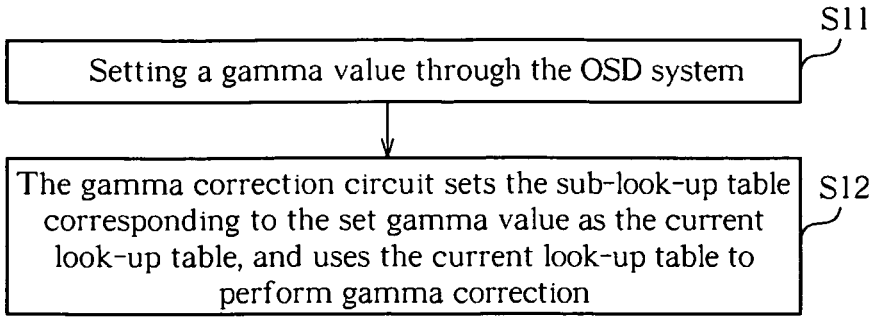
FIG. 3 is a flowchart of a method for controlling the LCD in FIG. 1 according to the first embodiment of the present disclosure.

FIG. 3 is a flowchart of a method for controlling the LCD 1 according to a first embodiment of the present disclosure.

In Step S11, a gamma value is set through the OSD system 12.

Via the input system 15 of the OSD system 12, the OSD menu 16 is opened, and a gamma value adjustment option thereof the OSD menu 16 becomes activated. The OSD system 12 transmits a corresponding control signal to the microprocessor 11.

In Step S12, gamma correction circuit 13 sets the sub-look-up table 131 corresponding to the gamma value set through the input system 15 as the active look-up table, and uses the active look-up table to perform gamma correction.

The microprocessor 11 directs the gamma correction circuit 13 according to the control signal to set the sub-look-up table 131 to correspond to the set gamma value as the active look-up table. Thus the sub-look-up table 131 corresponding to the gamma value set by the user becomes the active look-up table. The gamma correction circuit 13 searches the active look-up table for the corrected gray level value corresponding to the original gray level value, and outputs the corrected gray level value to the LCD panel 14 to display an image, thereby implementing adjustment of the gamma value conveniently.

Figure 4:
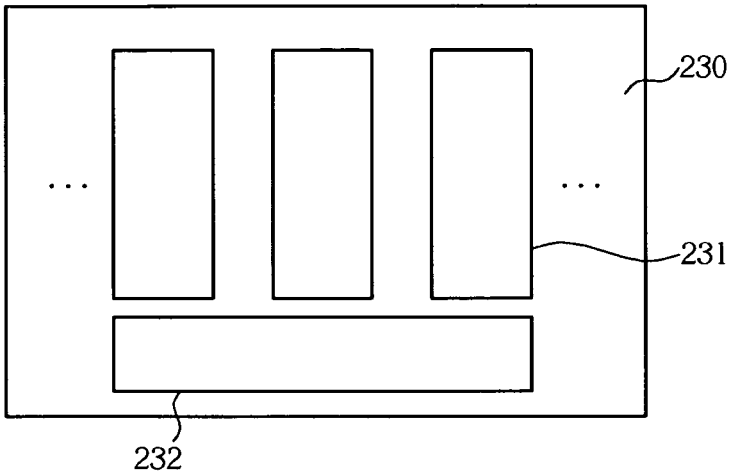
FIG. 4 shows a look-up table of the LCD in FIG. 1 according to a second embodiment of the present disclosure.

FIG. 4 shows a look-up table 230 of the LCD 1 according to a second embodiment of the present invention, differing from look-up table 130 only in the inclusion of a plurality of sub-look-up tables 231 and a common look-up table 232. Each gamma value corresponds to a unique sub-look-up table 231. All of the gamma values correspond to the same common look-up table 232.

When gray levels are less than or equal to 32, even if gamma values are different, the same original gray level values basically correspond to the same corrected gray level values. Thus original gray level values having gray levels exceeding 32 are defined as first original gray level values, and original gray level values having gray levels not exceeding 32 are defined as second original gray level values.

Each sub-look-up table 231 corresponds to a gamma value and stores a plurality of first original gray level values and a plurality of corrected gray level values corresponding to the first original gray level values. The common look-up table 232 corresponds to any of the available gamma values and stores a plurality of second original gray level values and a plurality of corrected gray level values corresponding to the second original gray level values. The combination of a sub-look-up table 231 and the common look-up table 232 stores complete original gray level values and a plurality of corrected gray level values corresponding to the complete original gray level values for a gamma value corresponding to the sub-look-up table 231.

When a gamma value is set, the OSD system 12 uses the microprocessor 11 to direct the gamma correction circuit 13 to set the sub-look-up table 231 corresponding to the set gamma value and the common look-up table 232 as the active look-up tables. After the microprocessor 11 receives a video signal, generates an original gray level value, and transmits the original gray level value to the gamma correction circuit 13, the gamma correction circuit 13 searches the active look-up tables for the corrected gray level value corresponding to the original gray level value, and outputs the corrected gray level value to the LCD panel 14. Then the LCD panel 14 displays an image according to the corrected gray level value.

The common look-up table 232 of the gamma correction circuit 13 stores a plurality of second original gray level values and a plurality of corrected gray level values corresponding to the second original gray level values for all available gamma values, conserving memory space for the look-up table 130 and reducing costs.

Figure 5:
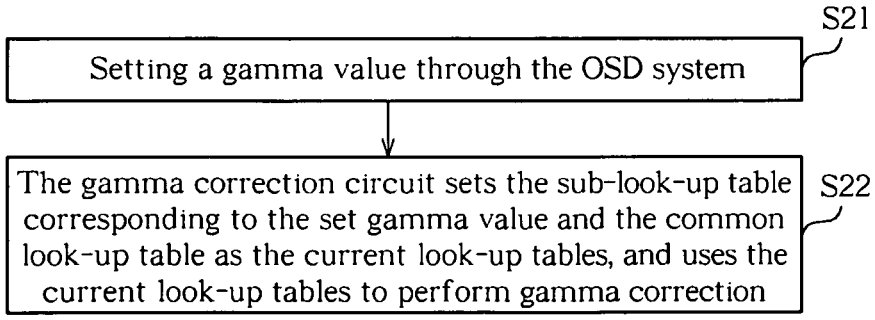
FIG. 5 is a flowchart of a method for controlling the LCD in FIG. 1 according to the second embodiment of the present disclosure.

FIG. 5 is a flowchart of a second embodiment of a method for controlling an LCD such as, for example, that of FIG. 1 according to disclosure.

In Step S21, a gamma value is set through the OSD system 12;

The input system 15 of the OSD system 12 opens the OSD menu 16, and a gamma value adjustment menu of the OSD menu 16. The OSD system 12 transmits a corresponding control signal to the microprocessor 11.

In Step S22, the gamma correction circuit 13 sets the sub-look-up table 231 corresponding to the gamma value set through the input system 15 and the common look-up table 232 as the active look-up tables, and uses the active look-up tables to perform gamma correction.

The microprocessor 11 directs the gamma correction circuit 13 according to the control signal to set the sub-look-up table 231 corresponding to the set gamma value and the common look-up table 232 as the active look-up tables. Thus, the sub-look-up table 231 corresponding to the gamma value set by the user and the common look-up table 232 becomes the active look-up tables. The gamma correction circuit 13 searches the active look-up tables for the corrected gray level value corresponding to the original gray level value, and outputs the corrected gray level value to the LCD panel 14 to display an image.

Alternatively, the OSD system 12 can be directly coupled to and direct the gamma correction circuit 13 to set the sub-look-up table 131 or 231, corresponding to the gamma value input through the input system 15 as the active look-up table.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A liquid crystal display (LCD) comprising:

an onscreen display (OSD) system comprising an input system for setting a gamma value of the LCD; and a gamma correction circuit comprising a look-up table, the look-up table comprising a plurality of sub-look-up tables each corresponding to a gamma value and having a plurality of original gray level values and a plurality of corrected gray level values corresponding to the plurality of original gray level values;

wherein the gamma correction circuit is configured for receiving an original gray level value of a video signal, and determining a corresponding corrected gray level value according to a gamma value set through the input system and a sub-look-up table corresponding to the gamma value set through the input system;

wherein the look-up table further includes a common look-up table corresponding to all available gamma values of the LCD, the common look-up table having a plurality of original gray level values and a plurality of corrected gray level values corresponding to the plurality of original gray level values, gray levels of the plurality of original gray level values of the common look-up table not exceeding a predetermined value, gray levels of a plurality of original gray level values of the sub-look-up table corresponding to the gamma value set through the input system exceed the predetermined value, and the gamma correction circuit sets the sub-look-up table corresponding to the gamma value set through the input system and the common look-up table as active look-up tables;

wherein the combination of the sub-look-up table and the common look-up table stores complete original gray level values and a plurality of corrected gray level values corresponding to the complete original gray level values for a gamma value corresponding to the sub-look-up table.

2. The LCD of claim 1, wherein the gamma correction circuit sets the sub-look-up table corresponding to the gamma value set through the input system as an active look-up table.

3. The LCD of claim 1, wherein the predetermined value is 32.

4. The LCD of claim 1, wherein the original gray level value represents an image brightness of the video signal, and the corrected gray level value represents image brightness of the video signal after gamma correction.

5. The LCD of claim 1, further comprising a microprocessor, wherein the OSD system controls the gamma correction circuit through the microprocessor.

6. The LCD of claim 1, further comprising an LCD panel, wherein the OSD system further comprises an OSD menu displayed on the LCD panel.

7. The LCD of claim 6, wherein the OSD menu comprises a gamma value adjustment option having a gamma value range, the gamma value adjustment option configured for setting of a gamma value within the gamma value range through the input system.

8. A method for controlling a liquid crystal display (LCD) comprising:

providing the LCD, the LCD comprising an onscreen display (OSD) system and a gamma correction circuit, the OSD system comprising an input system for setting a gamma value of the LCD, the gamma correction circuit comprising a look-up table, the look-up table comprising a plurality of sub-look-up tables each corresponding to a gamma value and having a plurality of original gray level values and a plurality of corrected gray level values corresponding to the plurality of original gray level values;

setting a gamma value through the input system of the OSD system; and the gamma correction circuit receiving an original gray level value of a video signal, and determining a corresponding corrected gray level value according to the gamma value set through the input system and a sub-look-up table corresponding to the gamma value set through the input system;

wherein the look-up table further includes a common look-up table corresponding to all available gamma values of the LCD, the common look-up table having a plurality of original gray level values and a plurality of corrected gray level values corresponding to the plurality of original gray level values, gray levels of the plurality of original gray level values of the common look-up table not exceeding a predetermined value, gray levels of a plurality of original gray level values of the sub-look-up table corresponding to the gamma value set through the input system exceed the predetermined value, and the gamma correction circuit sets the sub-look-up table corresponding to the gamma value set through the input system and the common look-up table as active look-up tables;

wherein the combination of the sub-look-up table and the common look-up table stores complete original gray level values and a plurality of corrected gray level values corresponding to the complete original gray level values for a gamma value corresponding to the sub-look-up table.

9. The method of claim 8, further comprising the gamma correction circuit setting the sub-look-up table corresponding to the gamma value set through the input system as an active look-up table.

10. The method of claim 8, wherein the predetermined value is 32.

11. The method of claim 8, wherein the original gray level value represents image brightness of the video signal, and the corrected gray level value represents image brightness of the video signal after gamma correction.

12. The method of claim 8, wherein the OSD system further comprises an OSD menu, the method further comprises the input system triggering a display of the OSD menu, triggering a gamma value adjustment option of the OSD menu, and setting or adjusting a gamma value within a gamma value range of the gamma value adjustment option.

* * * * *